US010648206B2

(12) United States Patent
Rodems et al.

(10) Patent No.: US 10,648,206 B2
(45) Date of Patent: May 12, 2020

(54) CORNER DRIVE ASSEMBLY FOR WINDOW LOCKING SYSTEM

(71) Applicant: Caldwell Manufacturing Company North America, LLC, Rochester, NY (US)

(72) Inventors: Eric Rodems, Spencerport, NY (US); James McInnis, Hilton, NY (US); Malcolm Muir, Honeoye Falls, NY (US)

(73) Assignee: Caldwell Manufacturing Company North America, LLC, Rochester, NY (US)

( * ) Notice: Subject to any disclaimer, the term of this patent is extended or adjusted under 35 U.S.C. 154(b) by 322 days.

(21) Appl. No.: 15/682,913

(22) Filed: Aug. 22, 2017

(65) Prior Publication Data

US 2019/0063125 A1 Feb. 28, 2019

(51) Int. Cl.
*E05C 9/24* (2006.01)
*E05F 7/08* (2006.01)
(Continued)

(52) U.S. Cl.
CPC ..... *E05C 9/24* (2013.01); *E05B 15/04* (2013.01); *E05D 15/5208* (2013.01); *E05F 7/08* (2013.01);
(Continued)

(58) Field of Classification Search
CPC ..... E05Y 2900/148; E05Y 2201/22; E05Y 2600/45; E05Y 2600/46; E05Y 2800/00;
(Continued)

(56) References Cited

U.S. PATENT DOCUMENTS 4,679,352 A * 7/1987 Bates ..... E05D 15/30 49/192
4,739,583 A * 4/1988 Tonsmann ..... E05D 15/5208 49/192

(Continued)

FOREIGN PATENT DOCUMENTS

DE 19709283 A1 9/1998
DE 19957358 A1 6/2001
WO WO 2003/083239 10/2003

OTHER PUBLICATIONS

Communication dated Sep. 9, 2019 in corresponding European Patent Application No. 181758186.

*Primary Examiner* — Mark A Williams
(74) *Attorney, Agent, or Firm* — Harness, Dickey & Pierce, P.L.C.

(57) ABSTRACT

A corner drive assembly for a window locking system includes a case, a corner transfer spring, and first and second arms. The case includes first and second legs aligned with respective first and second axes. The legs are joined by a corner portion having an outer relief surface that is disposed adjacent to and spaced apart from a corner of a window frame. The spring is slidably disposed within the corner portion and has first and second ends slidable along the first and second axes, respectively. The first arm is disposed within the first leg, slidable along the first axis, and coupled to the first end of the spring. The second arm is within the second leg, slidable along the second axis, and coupled to the second end of the spring. The first and second arms are coupled to respective first and second link bars of the locking system.

18 Claims, 5 Drawing Sheets

(51) Int. Cl.
*E05D 15/52* (2006.01)
*E05B 15/04* (2006.01)

(52) U.S. Cl.
CPC ..... *E05Y 2201/644* (2013.01); *E05Y 2201/66* (2013.01); *E05Y 2900/148* (2013.01)

(58) Field of Classification Search
CPC .. E05Y 2800/122; E05Y 2800/21; E05F 7/08; E05F 1/10; E05F 2015/631; E05C 9/24; E05C 9/063; E05C 9/006; E05C 9/066; E05C 17/30; Y10S 292/20; Y10S 292/33; Y10S 292/47; E05D 15/5214; E05D 15/30; E05D 15/00; E05D 15/04; E05D 7/1011; E05B 63/0052
See application file for complete search history.

(56) References Cited

U.S. PATENT DOCUMENTS 5,226,256 A * 7/1993 Fries ..... E05B 47/0012 49/13
6,122,863 A * 9/2000 Tippin ..... E05F 11/16 49/279
6,135,511 A * 10/2000 Smith ..... E05O 9/063 292/139
7,013,604 B1 3/2006 Moody et al.
7,340,860 B2 * 3/2008 Balbo Di Vinadio ..... E05D 15/5208 49/192
8,161,683 B2 * 4/2012 Van Parys ..... E05D 15/52 292/141
8,528,255 B2 * 9/2013 Lambertini ..... E05O 9/063 49/192
9,273,763 B2 3/2016 Evensen
2004/0163317 A1 * 8/2004 Reich ..... E05D 15/565 49/209
2005/0246979 A1 * 11/2005 Balbo Di Vinadio ..... E05D 15/5208 52/204.1
2007/0052247 A1 * 3/2007 Timothy ..... E05O 9/063 292/141
2008/0016782 A1 * 1/2008 Balbo Di Vinadio ..... E05D 15/5208 49/506
2015/0052817 A1 * 2/2015 Bourgoin ..... E05D 15/04 49/394
2016/0130847 A1 5/2016 Gramstad et al.

* cited by examiner

CORNER DRIVE ASSEMBLY FOR WINDOW LOCKING SYSTEM

FIELD

The present disclosure relates to a corner drive assembly for a window locking system, such as may be included in a vent operator for a casement-style or a projection-style window assembly.

BACKGROUND

This section provides background information related to the present disclosure which is not necessarily prior art.

Vent operators, like that disclosed in International Patent Application Publication No. WO 2016/037186 A1 entitled "Vent Operator", are known to be employed in casement-style or projection-style window assemblies. Vent operators may also include a locking system. The locking system may include multiple lock points. For example, a window assembly may include lock points at both the side and top of the window sash or frame. Vent operator locking systems may also include one or more corner drive assemblies for transferring load and motion around a corner of a window sash or frame. Thus, vent operator locking systems can transfer movement of a horizontal lock bar through the corner drive assembly and correspondingly move a vertical lock bar, or a vertical lock bar through the corner drive assembly and correspondingly move a horizontal lock bar.

SUMMARY

This section provides a general summary of the disclosure, and is not a comprehensive disclosure of its full scope or all of its features.

In one form, the present disclosure provides a corner drive assembly for a locking system for a window. The corner drive assembly includes a case, a corner transfer spring, a first arm, and a second arm. The case can be mounted to a window frame.

The case includes a first leg, a second leg, and a corner portion. The first leg is substantially aligned with a first axis. The first leg includes a first interior surface defining a first interior compartment. The second leg is substantially aligned with a second axis perpendicular to the first axis. The second leg includes a second interior surface defining a second interior compartment. The corner portion joins the first leg and the second leg. The corner portion includes an outer relief surface and a third interior compartment. The outer relief surface can be disposed adjacent to a corner of the window frame and spaced apart from the window frame. The third interior compartment is coextensive with the first and second interior compartments.

The corner transfer spring is at least partially slidably disposed in the third interior compartment. The corner transfer spring has a first end and a second end. The first end is slidable along the first axis. The second end is slidable along the second axis.

The first arm is disposed in the first interior compartment. The first arm is slidable along the first axis. The first arm is coupled to the first end of the corner transfer spring. The second arm is disposed in the second interior compartment. The second arm is slidable along the second axis. The second arm is coupled to the second end of the corner transfer spring. The first and second arms can be coupled to respective first and second link bars of the locking system.

In some embodiments, the first leg further includes a first outer surface. The first outer surface can abut an inner surface of the window frame. The second leg further includes a second outer surface. The second outer surface can abut the inner surface of the window frame.

In some embodiments, the first leg also includes a first outer surface and a first pair of opposing rails. The first pair of opposing rails is adjacent to and flush with the first outer surface. The first pair of opposing rails is substantially parallel with the first axis. The second leg further includes a second outer surface and a second pair of opposing rails. The second pair of opposing rails is adjacent to and flush with the second outer surface. The second pair of opposing rails is substantially parallel to the second axis. The first pair of opposing rails and the second pair of opposing rails can engage the window frame.

In some embodiments, the first interior compartment includes a first pair of opposing channels. The first pair of opposing channels is substantially parallel to the first axis. The second interior compartment includes a second pair of opposing channels. The second pair of opposing channels is substantially parallel to the second axis. The first arm can be slidably disposed within the first pair of opposing channels. The second arm can be slidable disposed within the second pair of opposing channels.

In some embodiments, the first interior compartment further includes a first pair of opposing grooves. The first pair of opposing grooves is substantially parallel to the first axis. The second interior compartment further includes a second pair of opposing grooves. The second pair of opposing grooves is substantially parallel to the second axis. The first end of the corner transfer spring is slidably disposed in the first pair of opposing grooves. The second end of the corner transfer spring is slidably disposed in the second pair of opposing grooves.

In some embodiments, the corner drive assembly further includes a corner insert. The corner insert is disposed within the third interior compartment. The corner insert includes a curved passageway. The corner transfer spring is partially slidably disposed within the curved passageway.

In some embodiments, the curved passageway includes a bearing surface. The bearing surface has a first coefficient of friction. The case has a second coefficient of friction. The first coefficient of friction is less than the second coefficient of friction.

In another form, a corner drive assembly for a locking system of for window includes a case, a corner insert, a corner transfer spring, a first arm, and a second arm. The case can be mounted to a window frame. The case includes a first leg, a second leg, and a corner portion. The first leg is substantially aligned with a first axis. The first leg includes a first interior compartment. The second leg is substantially aligned with a second axis. The second axis is perpendicular to the first axis. The second leg includes a second interior compartment. The corner portion joins the first leg and the second leg. The corner portion includes a third interior compartment. The third interior compartment is coextensive with the first and second interior compartments. The corner insert is disposed within the third interior compartment of the case. The corner insert includes a curved passageway.

The corner transfer spring is slidably disposed in the curved passageway of the corner insert. The corner transfer spring has a first end and a second end. The first end is movable long the first axis. The second end is movable along the second axis. The first arm is disposed in the first interior compartment. The first arm is slidable along the first axis. The first arm is coupled to the first end of the corner transfer spring. The second end is coupled to the second end of the corner transfer spring. The second arm is disposed in the second interior compartment. The second arm is slidable along the second axis. The second arm is coupled to the second end of the corner transfer spring. Motion of the first arm along the first axis causes corresponding motion of the second arm along the second axis.

In some embodiments, the curved passageway includes a bearing surface. A first coefficient of kinetic friction between the corner transfer spring and the bearing surface is less than a second coefficient of kinetic friction between the corner transfer spring and the case.

In some embodiments, the first coefficient of friction kinetic friction is less than or equal to about 0.35.

In some embodiments, the corner insert includes a lubricant and a polymer including acetal homopolymer $(CH_2O)_n$).

In some embodiments, the corner portion includes an outer relief surface. The outer relief surface can be disposed adjacent to a corner of the window frame. The outer relief surface can be spaced apart from the window frame.

In some embodiments, the first leg further includes a first outer surface. The first outer surface can abut an inner surface of the window frame. The second leg further includes a second outer surface. The second outer surface can abut the inner surface of the window frame.

In some embodiments, the first leg further includes a first outer surface and a first pair of opposing rails. The first pair of opposing rails is adjacent to and flush with the first outer surface. The first pair of opposing rails is substantially parallel with the first axis. The second leg further includes a second outer surface and a second pair of opposing rails. The second pair of opposing rails is adjacent to and flush with the second outer surface. The second pair of opposing rails is substantially parallel to the second axis. The first pair of opposing rails and the second pair of opposing rails can engage the window frame.

In yet another form, the present disclosure provides a corner drive assembly for a locking system for a window. The corner drive assembly includes a case, a corner transfer spring, a first arm, and a second arm. The case can be mounted to a window frame.

The case includes a first leg, a second leg, and a corner portion. The first leg is substantially aligned with a first axis. The first leg includes a first interior compartment and a first mounting feature. The second leg is substantially aligned with a second axis perpendicular to the first axis. The second leg includes a second interior compartment and a second mounting feature. The corner portion joins the first leg and the second leg. The corner portion includes a third interior compartment. The third interior compartment is coextensive with the first and second interior compartments.

The corner transfer spring is slidably disposed in the third interior compartment. The corner transfer spring has a first end and a second end. The first end is movable along the first axis. The second end is movable along the second axis. The first arm is disposed in the first interior compartment. The first arm is slidable with respect to the first axis. The first arm is coupled to the first end of the corner transfer spring. The first arm includes a first slot. The first slot is substantially aligned with the first axis. The second arm is disposed in the second interior compartment. The second arm is slidable with respect to the second axis. The second arm is coupled to the second end of the corner transfer spring. The second arm includes a second slot. The second slot is substantially aligned with the second axis. The first mounting feature and the first slot are aligned and can receive a first fastener for fixing the first leg of the case to the window frame. The second mounting feature and the second slot are aligned and can receive a second fastener for fixing the second leg of the case to the window frame. Motion of the first arm along the first axis causes corresponding motion of the second arm along the second axis.

In some embodiments, the first and second arms have a length. The first and second slots can slide a distance equal to the length within the first and second legs, respectively.

In some embodiments, the first leg includes a first pair of opposing side surfaces. The first mounting feature is disposed equidistant between the side surfaces of the first pair. The second leg includes a second pair of opposing side surfaces. The second mounting feature is disposed equidistant between the side surfaces of the second pair.

In some embodiments, the corner portion includes an outer relief surface. The outer relief surface can be disposed adjacent to a corner of the window frame. The outer relief surface can be spaced apart from the window frame.

In some embodiments, the corner drive assembly further includes a corner insert. The corner insert is disposed within the third interior compartment. The corner insert includes a curved passageway. The curved passageway has a bearing surface. The corner transfer spring is partially disposed within the curved passageway. The corner transfer spring is slidable with respect to the curved passageway. The bearing surface has a first coefficient of friction. The case has a second coefficient of friction. The second coefficient of friction is less than the first coefficient of friction.

In some embodiments, the first leg further includes a first outer surface and a first pair of opposing rails. The first pair of opposing rails is adjacent to and flush with the first outer surface. The first pair of opposing rails is substantially parallel with the first axis. The second leg further includes a second outer surface and a second pair of opposing rails. The second pair of opposing rails is adjacent to and flush with the second outer surface. The second pair of opposing rails is substantially parallel to the second axis. The first pair of opposing rails and the second pair of opposing rails can engage the window frame.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
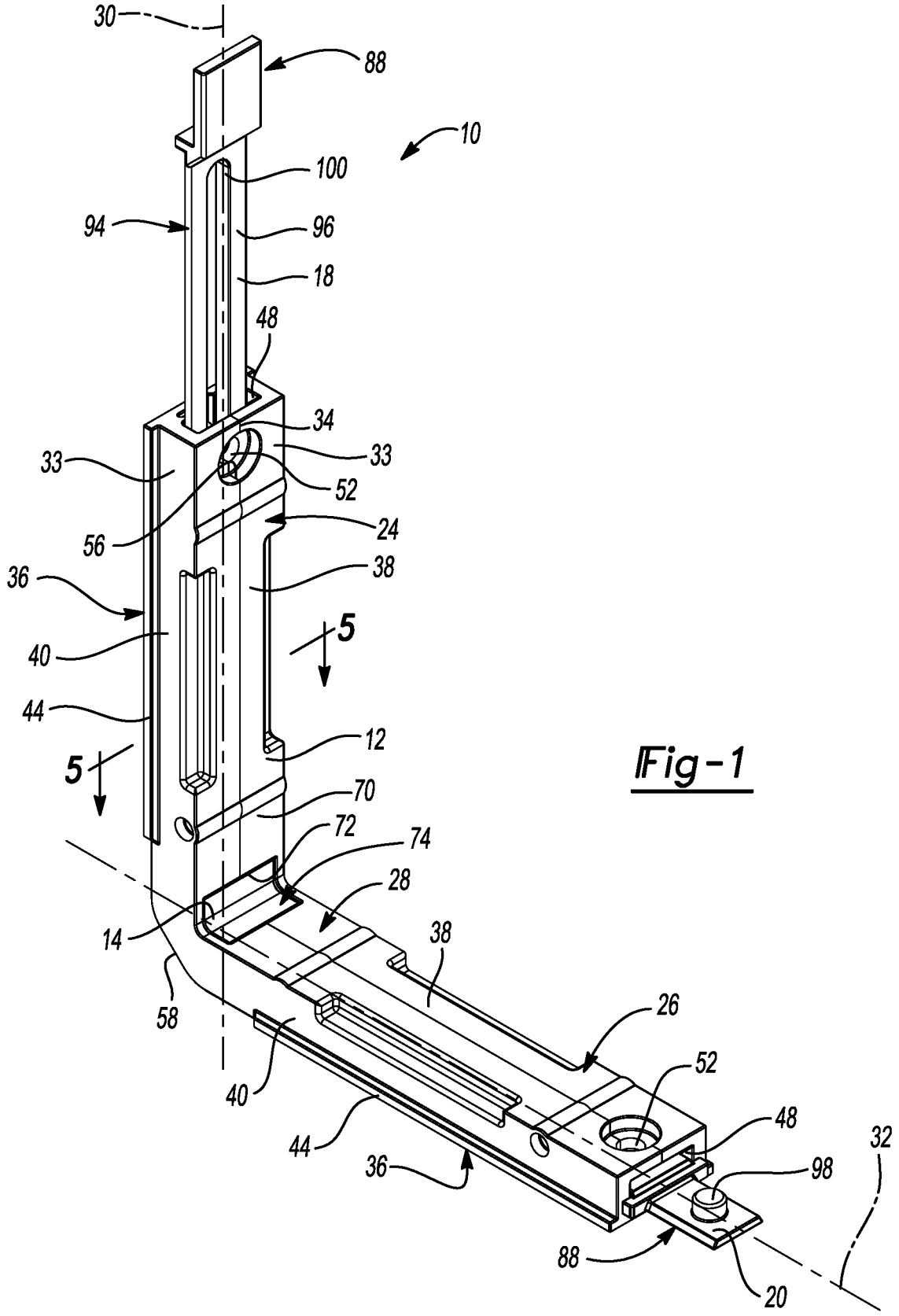
FIG. 1 is a top perspective view of a corner drive assembly according to the principles of the present disclosure.
Figure 2:
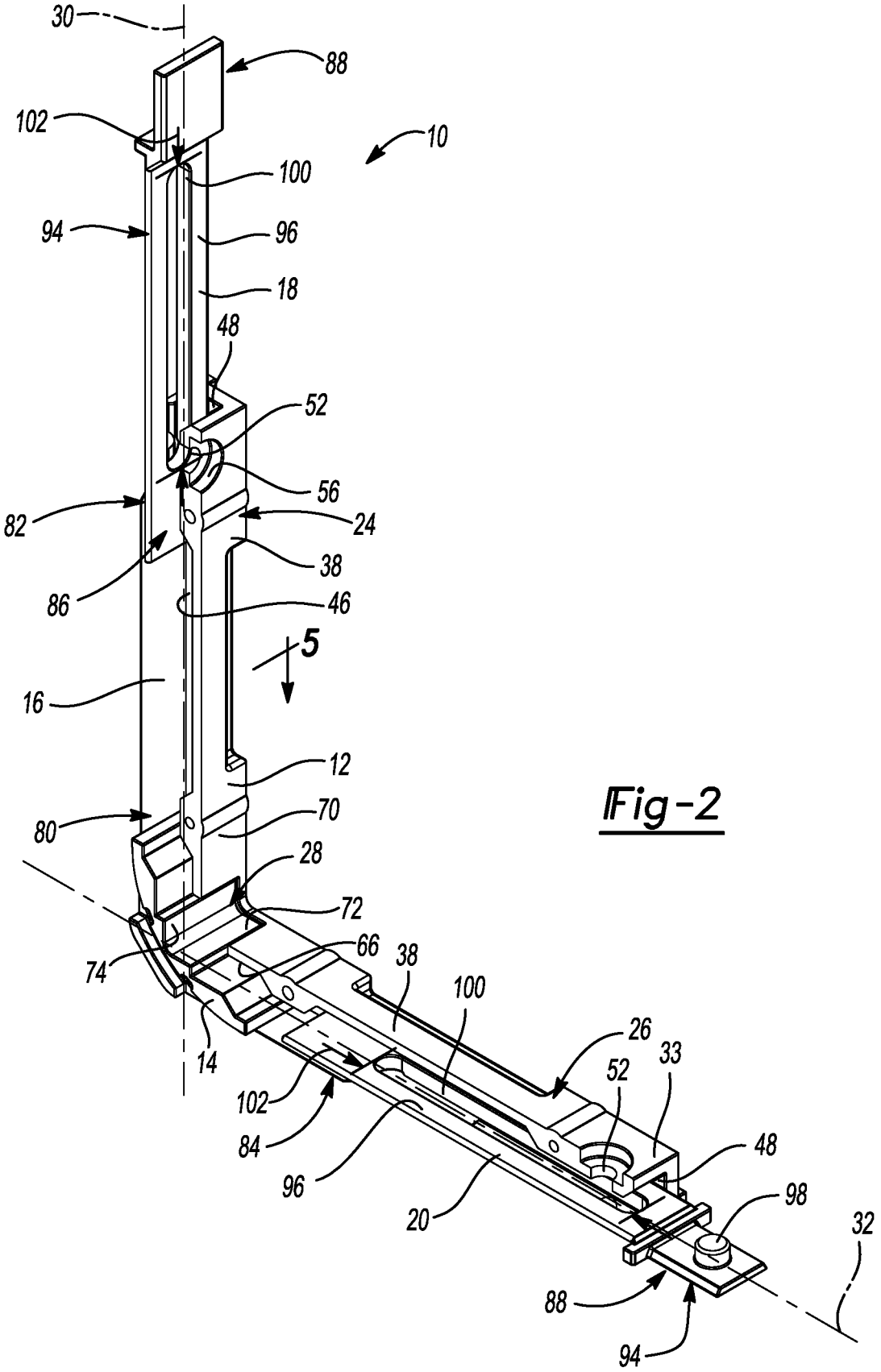
FIG. 2 is a top perspective view of the corner drive assembly of FIG. 1 having a portion of a case removed.

With reference to FIGS. 1 and 2, a corner drive assembly 10 for a locking system of a vent operator for a window is provided. The corner drive assembly 10 may include a case 12, a corner insert 14, a corner transfer spring 16, and first and second arms 18, 20. A window frame 22 (shown in FIG. 3) may include one or more corner drive assemblies 10. The corner drive assembly 10 may be mounted to the window frame 22 to transmit horizontal motion to vertical motion or vertical motion to horizontal motion. For example, an operator may move a handle to slide a lock bar horizontally, which in turn causes a perpendicular lock bar to slide vertically (not shown).

The case 12 may include first and second legs 24, 26 connected by a corner portion 28. The corner portion 28 is disposed between the first and second legs 24, 26. The first and second legs 24, 26 may be identical and perpendicularly oriented. More specifically, the first leg 24 may be substantially aligned with a first axis 30 and the second leg 26 may be substantially aligned with a second axis 32. The first axis 30 may be substantially perpendicular to the second axis 32. By way of example, the first axis 30 may be parallel to a vertical window sash (not shown) and the second axis 32 may be parallel to a horizontal window sash (not shown).

The case 12 may comprise one or more pieces. In one example, the case 12 may comprise two halves 33 joined at a seam 34. In another example, the entire case 12 may be integrally formed (not shown). In yet another example, each of the first and second legs 24, 26 may be a separate piece attached to the corner portion 28. The case 12 may comprise glass-filled nylon, by way of non-limiting example.

Each leg 24, 26 may include an outer surface 36, an inner surface 38, and opposing side surfaces 40. The side surfaces 40 may be substantially parallel to one another. Each side surface 40 may be substantially perpendicular to the outer surface 36 and the inner surface 38. The outer surface 36 may be sized and shaped to complement an inner surface 42 of the window frame 22 (shown in FIG. 3).

Each leg 24, 26 may include a pair of opposing rails 44 adjacent to and flush with the outer surface 36. The opposing rails 44 may extend from respective side surfaces 40. The opposing rails 44 may engage opposing rail grooves (not shown) in the window frame 22 for positioning the corner drive assembly 10 within the window frame 22. The opposing rails 44 may be integrally formed with the case 12 and flush with the outer surface 36. The opposing rails 44 of the first leg 24 may be substantially parallel with the first axis 30 and the opposing rails 44 of the second leg 26 may be substantially parallel with the second axis 32.

Figure 5:
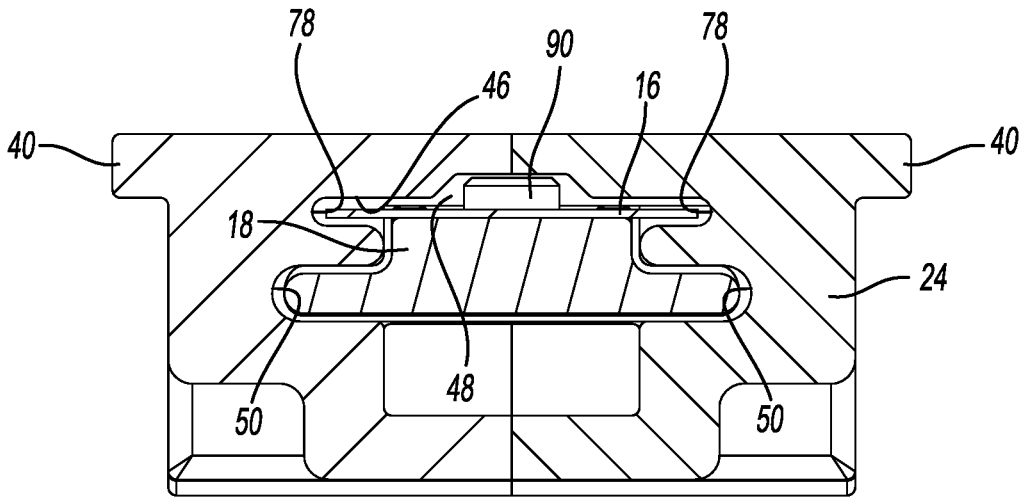
FIG. 5 is a cross-sectional view of the corner drive assembly of FIG. 1 taken at line 5-5 of FIG. 1.

Each leg 24, 26 may also include an interior surface 46 defining an interior compartment 48. Referring to FIG. 5, the interior compartment 48 may include a pair of opposing channels 50. The opposing channels 50 of the first leg 24 may be substantially parallel to the first axis 30 and the opposing channels 50 of the second leg 26 may be substantially parallel with the second axis 32.

Returning to FIGS. 1 and 2, each leg 24, 26 may include a mounting feature 52. In one example, the mounting feature 52 may include a first bore (not shown) extending into the outer surface 36 and a second bore 56 that may be a counterbore extending into the inner surface 38. In other non-limiting examples, the mounting feature 52 may include first and second threaded bores or first and second slots formed in respective outer and inner surfaces (not shown). Each mounting feature 52 may receive a respective fastener (not shown) to fix the case 12 to the window frame 22. The mounting feature 52 may be centered between the opposing side surfaces 40 of the case 12. Thus, the mounting feature 52 may also be centered with respect to the window frame 22.

Figure 3:
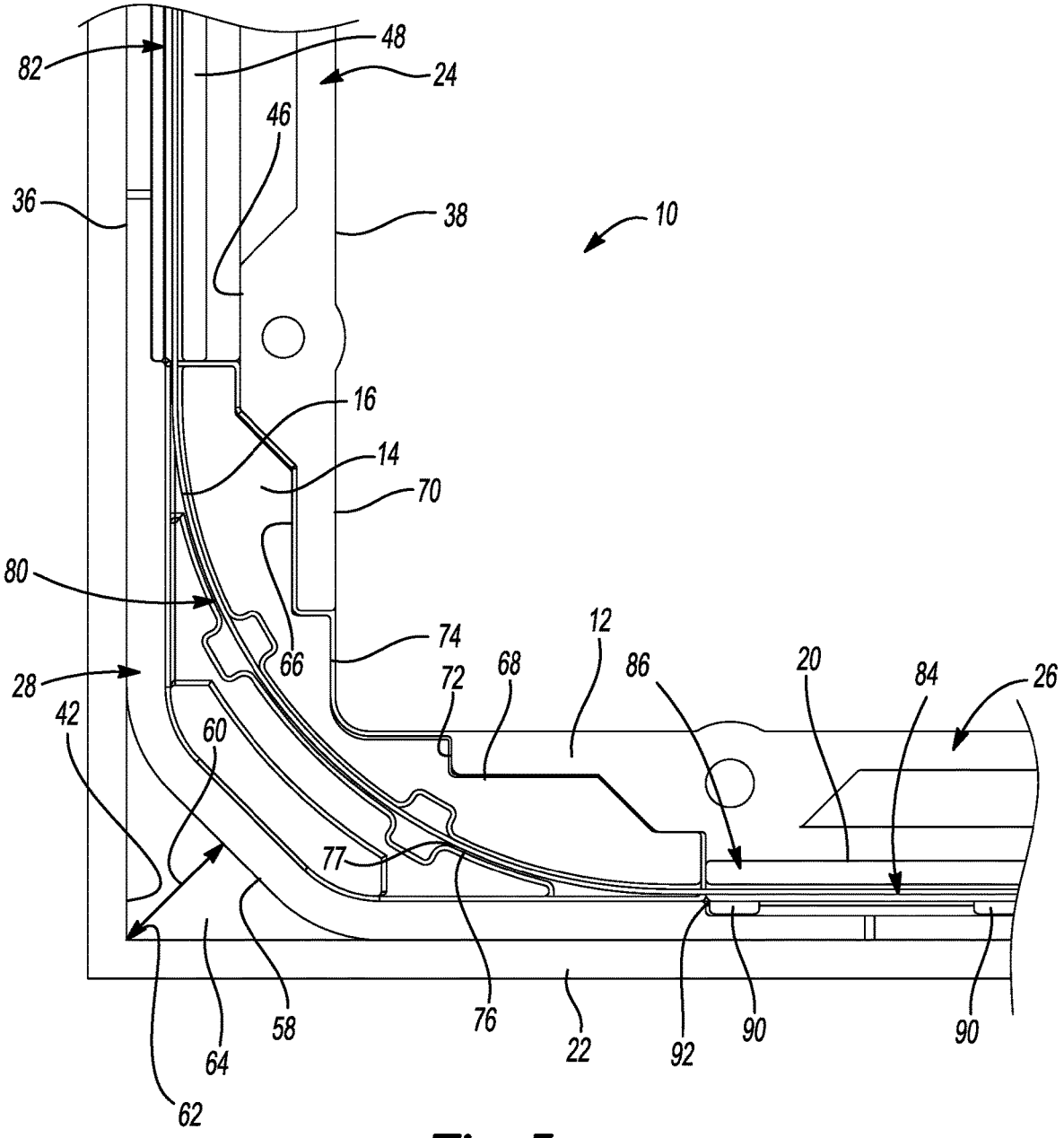
FIG. 3 is a partial cross-sectional view of the corner drive assembly of FIG. 1 taken at line 4-4 of FIG. 1.
Figure 4:
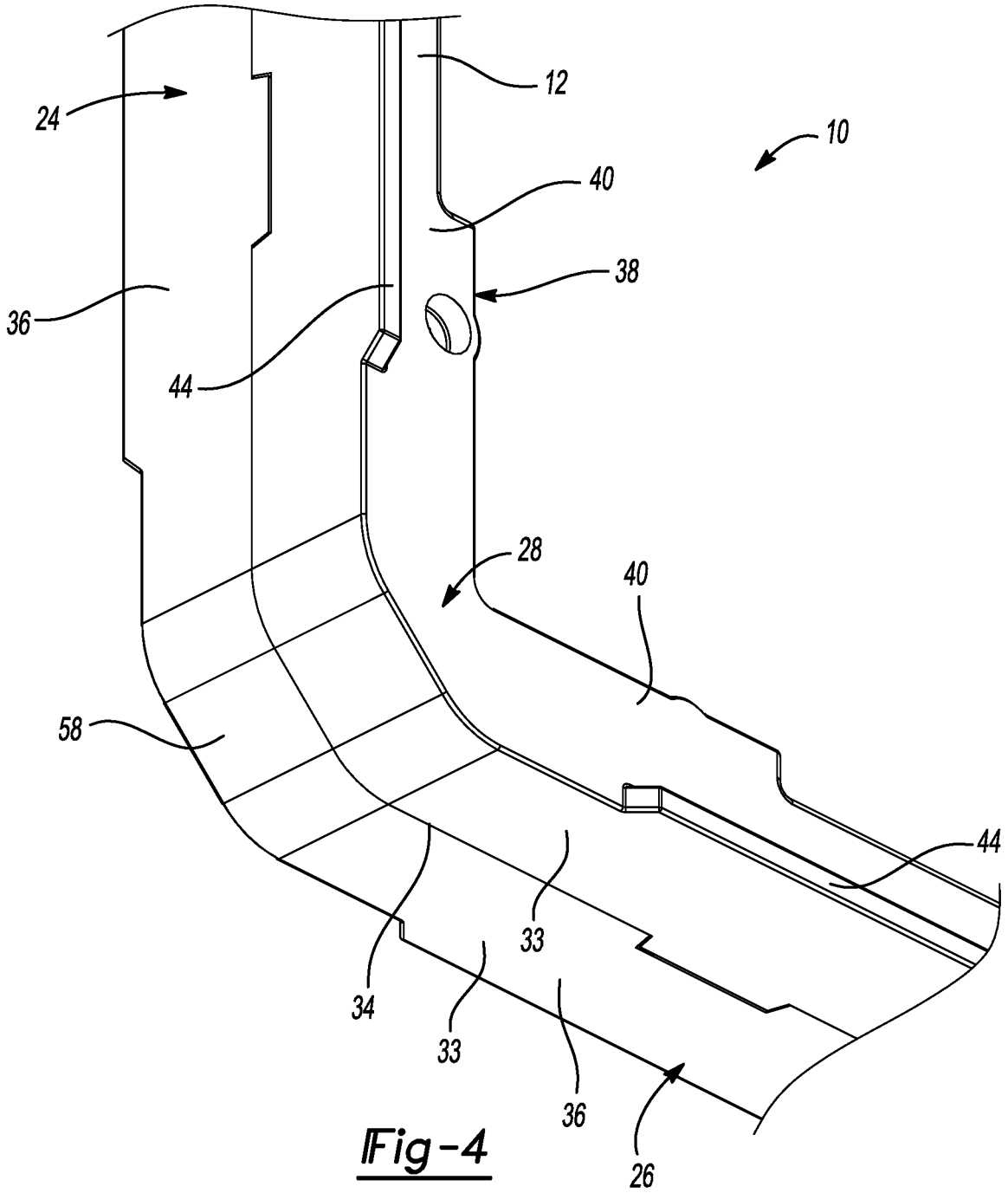
FIG. 4 is a partial bottom perspective view of a corner portion of the case of the corner drive assembly of FIG. 1.

Referring to FIGS. 3 and 4, the corner portion 28 of the case 12 may be disposed between the first leg 24 and the second leg 26 and join the first leg 24 to the second leg 26. The corner portion 28 may include an outer relief surface 58. When the corner drive assembly 10 is placed in the window frame 22, a gap 60 may be defined between the outer relief surface 58 and an inside corner 62 of the window frame 22. Thus, when the corner drive assembly 10 is installed on the window frame 22, there is an open space 64 between the window frame 22 and the case 12 of the corner drive assembly 10. The open space 64 is particularly advantageous, for example, when adhesive or silicone is present in the corner 62 of the window frame 22 because it allows the first and second legs 24, 26 of the case 12 to be mounted flush with the inner surface 42 of the window frame 22 without interference by the corner portion 28 with the adhesive or silicone.

The corner portion 28 may also include an interior surface 66 defining an interior compartment 68 that is disposed between the respective interior compartments 48 of the first leg 24 and the second leg 26 and coextensive with the interior compartments 48 of the first leg 24 and the second leg 26. The corner portion 28 may also include an inner surface 70 opposite the outer relief surface 58. The inner surface 70 may include an opening 72. In other examples, the interior compartment 68 of the corner portion 28 may be fully enclosed such that the inner surface 70 is free of any openings or holes (not shown).

As best shown in FIGS. 2 and 3, the corner insert 14 may be disposed within the interior compartment 68 of the corner portion 28 of the case 12 and may occupy the entire interior compartment 68. The corner insert 14 may include an exposed portion 74 at the opening 72 of the corner portion 28. The exposed portion 74 of the corner insert 14 may be flush with the inner surface 70 of the corner portion 28 of the case 12. The corner insert 14 may include a curved passageway 76 having a bearing surface 77.

Figure 6:
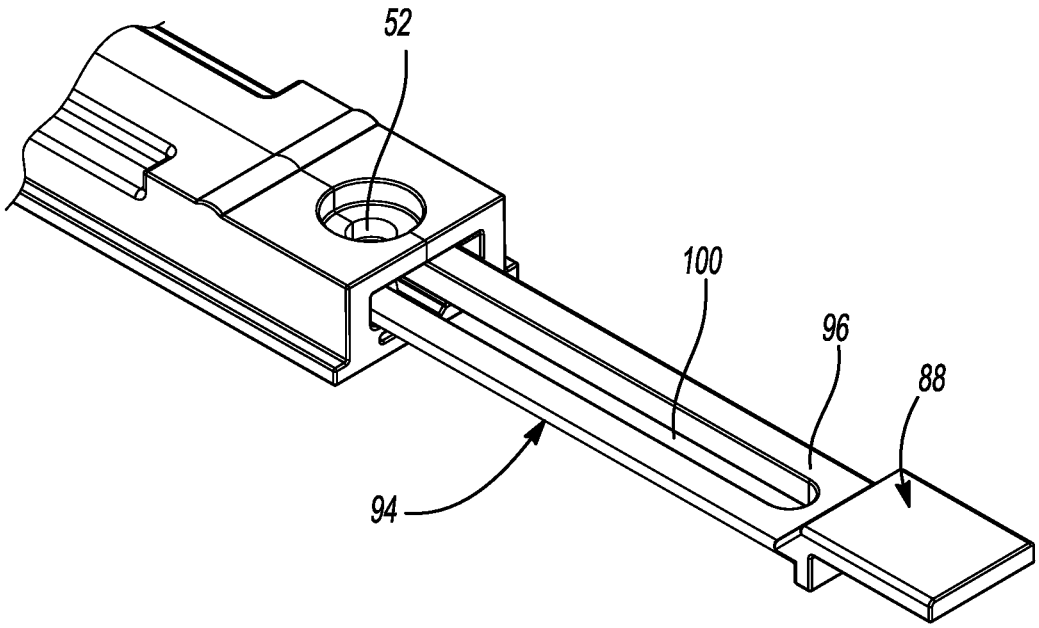
FIG. 6 is a partial perspective view of the corner drive assembly of FIG. 1 showing a leg of the case and an arm.

The corner transfer spring 16 is slidable with respect to the case 12 and the corner insert 14. The corner transfer spring 16 may be at least partially disposed within the curved passageway 76 of the corner insert 14. The bearing surface 77 of the corner insert 14 is directly adjacent to the corner transfer spring 16. Referring to FIG. 6, the corner transfer spring 16 may be partially disposed in respective pairs of opposing grooves 78 in the first and second legs 24, 26 of the case 12. More specifically, as shown in FIG. 4, a center section 80 of the corner transfer spring 16 is disposed in the curved passageway 76 of the corner insert 14, a first end 82 of the corner transfer spring 16 is disposed in the pair of opposing grooves 78 of the first leg 24 of the case 12, and a second end 84 of the corner transfer spring 16 is disposed in the pair of opposing grooves 78 of the second leg of the case 12. The opposing grooves 78 support the first and second ends 82, 84 of the corner transfer spring 16 and enable the corner transfer spring 16 to resist buckling under compressive loading.

The corner transfer spring 16 may be a thin strip of metal tape. In one example, the corner transfer spring 16 is 0.0105 inches thick and 0.465 inches wide. The metal tape may comprise steel or stainless steel, by way of non-limiting example.

The corner insert 14 may comprise plastic having low coefficients of static friction and/or kinetic friction compared to the material of the case 12. The coefficient of kinetic friction between the corner insert 14 and the corner transfer spring 16 may be less than or equal to about 0.40, optionally less than or equal to about 0.35, optionally less than or equal to about 0.30, optionally less than or equal to about 0.25, optionally less than or equal to about 0.20, optionally less than or equal to about 0.15. Thus, the corner transfer spring 16 can freely slide along the bearing surface 77 of the corner insert 14. The corner insert 14 may comprise an acetal or polyoxymethylene $(CH_2O)_n$) plastic, such as an acetal homopolymer or a copolymer. Examples of acetal plastics include Delrin®, Celcon®, Ramtal, Duracon®, Kepital®, and Hostaform®, by way of non-limiting example. The corner transfer insert may further comprise a lubricant, such as polytetrafluoroethylene ("PTFE"). In one example, the corner insert 14 comprises acetal homopolymer and PTFE at 12% by mass.

With reference to FIGS. 3 and 6, each of the first and second arms 18, 20 may include a spring end 86 and a lock end 88. The spring end 86 of the first arm 18 is connected to the first end 82 of the corner transfer spring 16 and the spring end 86 of the second arm 20 is connected to the second end 84 of the corner transfer spring 16. The first and second arms 18, 20 and first and second ends 82, 84 of the spring may include respective fastening features, such as bosses 90 and holes 92. More specifically, each end 82, 84 of the corner transfer spring 16 may include one or more holes 92. The holes 92 may be sized to fit over one or more respective bosses 90 on an outer surface 94 of each spring end 86 of the first and second arms 18, 20. The bosses 90 may be peened.

The lock end 88 of the first arm 18 may be connected to a first link bar of a locking system (not shown). The lock end 88 of the second arm 20 may be connected to a second link bar of the locking system (not shown). The lock end 88 of each of the first and second arms 18, 20 may include a feature for attachment to the respective link bars. For example, an inner surface 96 of the lock end 88 of each of the first and second arms 18, 20 may include one or more bosses 98.

Each of the first and second arms 18, 20 may also include a respective slot 100 extending between the outer surface 94 and the inner surface 96. The slots 100 may be used to slidably connect the first and second arms 18, 20 to the first and second legs 24, 26 of the case 12, respectively, and the case 12 to the window frame 22. The slots 100 may be aligned with the mounting features 52 of the case 12 in a direction perpendicular to the window frame 22. The slots 100 may have a length 102 in a direction parallel to the first and second axes 30, 32.

The first and second arms 18, 20 are slidable along the first and second axes 30, 32, respectively, up to a distance equal to the length 102 of the slots 100. The slots 100 enable the case 12 to be mounted to the window frame independent of the position of the first and second arms 18, 20. As shown by the position of the first arm 18 and first leg 24 of the case 12, there is clearance for a fastener to pass through the mounting feature 52 and the slot 100 when the first arm 18 is fully extended. Similarly, as shown by the position of the second arm 20 and the second leg 26 of the case 12, there is clearance for a fastener to pass through the mounting feature 52 and the slot 100 when the second arm 20 is fully retracted. The first and second arms 18, 20 may comprise zinc (e.g., Zamak 5) or cast steel, by way of non-limiting example.

One of the first and second link bars may be connected to a handle (not shown) for an operator to lock or unlock the window. When the operator actuates the handle, which may be attached to a horizontal window sash, for example, the second or horizontal lock bar is moved along the second axis 32. Motion of the second lock bar along the second axis 32 causes motion of the second arm 20 along the second axis 32. The motion of the second arm 20 along the second axis 32 is transferred through the corner transfer spring 16 to the first arm 18. Motion of the first arm 18 along the first axis 30 causes motion of the first lock bar, which may lock or unlock the window.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A corner drive assembly for a locking system of a window comprising:

a case configured to be mounted to a window frame, the case comprising:

a first leg substantially aligned with a first axis and comprising a first interior compartment;

a second leg substantially aligned with a second axis perpendicular to the first axis and comprising a second interior compartment; and a corner portion joining the first leg and the second leg, the corner portion comprising a third interior compartment coextensive with the first and second interior compartments;

a corner insert disposed within the third interior compartment of the case, the corner insert including a curved passageway;

a corner transfer spring slidably disposed in the curved passageway of the corner insert and having a first end movable along the first axis and a second end movable along the second axis;

a first arm disposed in the first interior compartment and slidable along the first axis, the first arm being coupled to the first end of the corner transfer spring; and a second arm disposed in the second interior compartment and slidable along the second axis, the second arm being coupled to the second end of the corner transfer spring, wherein motion of the first arm along the first axis causes corresponding motion of the second arm along the second axis, wherein the curved passageway includes a bearing surface, a first coefficient of friction is between the bearing surface and the corner transfer spring, and a second coefficient of friction is between the case and the corner transfer spring, and wherein the first coefficient of friction is less than the second coefficient of friction.

2. The corner drive assembly of claim 1, wherein the first coefficient of friction is coefficient of kinetic friction between the corner transfer spring and the bearing surface, and wherein the coefficient of kinetic friction is less than or equal to about 0.35.

3. The corner drive assembly of claim 1, wherein the corner insert comprises a lubricant and a polymer comprising acetal homopolymer $(CH_2O)_n$).

4. The corner drive assembly of claim 1, wherein the corner portion includes an outer relief surface configured to be disposed adjacent to a corner of the window frame, wherein the outer relief surface is configured to be spaced apart from the window frame.

5. The corner drive assembly of claim 1, wherein:

the first leg further comprises a first outer surface configured to abut an inner surface of the window frame; and the second leg further comprises a second outer surface configured to abut the inner surface of the window frame.

6. The corner drive assembly of claim 1, wherein:

the first leg further comprises a first outer surface and a first pair of opposing rails adjacent to and flush with the first outer surface, the first pair of opposing rails being substantially parallel with the first axis;

the second leg further comprises a second outer surface and a second pair of opposing rails adjacent to and flush with the second outer surface, the second pair of opposing rails being substantially parallel to the second axis; and the first pair of opposing rails and the second pair of opposing rails are configured to engage the window frame.

7. A corner drive assembly for a locking system of a window comprising:

a case configured to be mounted to a window frame, the case comprising:

a first leg substantially aligned with a first axis and comprising a first interior compartment and a first mounting feature;

a second leg substantially aligned with a second axis perpendicular to the first axis and comprising a second interior compartment and a second mounting feature; and a corner portion joining the first leg and the second leg, the corner portion comprising a third interior compartment coextensive with the first and second interior compartments;

a corner insert disposed within the third interior compartment, the corner insert comprises a curved passageway having a bearing surface;

a corner transfer spring slidably disposed in the third interior compartment and having a first end movable along the first axis and a second end movable along the second axis;

a first arm disposed in the first interior compartment and slidable with respect to the first axis, the first arm being coupled to the first end of the corner transfer spring and including a first slot substantially aligned with the first axis; and a second arm disposed in the second interior compartment and slidable with respect to the second axis, the second arm being coupled to the second end of the corner transfer spring and including a second slot substantially aligned with the second axis, wherein:

the first mounting feature and the first slot are aligned and configured to receive a first fastener for fixing the first leg of the case to the window frame;

the second mounting feature and the second slot are aligned and configured to receive a second fastener for fixing the second leg of the case to the window frame;

wherein motion of the first arm along the first axis causes corresponding motion of the second arm along the second axis, wherein the corner transfer spring is partially disposed within the curved passageway and slidable with respect to the bearing surface of the curved passageway, a first coefficient of friction is between the bearing surface and the corner transfer spring, and a second coefficient of friction is between the case and the corner transfer spring, and wherein the first coefficient of friction is less than the second coefficient of friction.

8. The corner drive assembly of claim 7, wherein the first and second slots have a length and the first and second arms are configured to slide a distance equal to the length within the first and second legs, respectively.

9. The corner drive assembly of claim 7, wherein:

the first leg includes a first pair of opposing side surfaces and the first mounting feature is disposed equidistant between the side surfaces of the first pair; and the second leg includes a second pair of opposing side surfaces and the second mounting feature is disposed equidistant between the side surfaces of the second pair.

10. The corner drive assembly of claim 7, wherein the corner portion includes an outer relief surface configured to be disposed adjacent to a corner of the window frame, wherein the outer relief surface is configured to be spaced apart from the window frame.

11. The corner drive assembly of claim 7, wherein:

the first leg further comprises a first outer surface and a first pair of opposing rails adjacent to and flush with the first outer surface, the first pair of opposing rails being substantially parallel with the first axis;

the second leg further comprises a second outer surface and a second pair of opposing rails adjacent to and flush with the second outer surface, the second pair of opposing rails being substantially parallel to the second axis; and the first pair of opposing rails and the second pair of opposing rails are configured to engage the window frame.

12. A corner drive assembly for a locking system for a window comprising:

a case configured to be mounted to a window frame, the case comprising:

a first leg substantially aligned with a first axis and comprising a first interior surface defining a first interior compartment;

a second leg substantially aligned with a second axis perpendicular to the first axis and comprising a second interior surface defining a second interior compartment; and a corner portion joining the first leg and the second leg, the corner portion comprising an outer relief surface configured to be disposed adjacent to a corner of the window frame and a third interior compartment coextensive with the first and second interior compartments;

a corner insert disposed within the third interior compartment and supported by a surface of the corner portion that defines the third interior compartment, the corner insert comprises a curved passageway having a bearing surface;

a corner transfer spring at least partially slidably disposed within the curved passageway and slidable with respect to the bearing surface;

a first arm disposed in the first interior compartment and slidable along the first axis, the first arm being coupled to the first end of the corner transfer spring; and a second arm disposed in the second interior compartment and slidable along the second axis, the second arm being coupled to the second end of the corner transfer spring;

wherein a first coefficient of friction is between the bearing surface and the corner transfer spring, and a second coefficient of friction is between the case and the corner transfer spring, and wherein the first coefficient of friction is less than the second coefficient of friction.

13. The corner drive assembly of claim 12, wherein:

the first leg further comprises a first outer surface configured to abut an inner surface of the window frame; and the second leg further comprises a second outer surface configured to abut the inner surface of the window frame.

14. The corner drive assembly of claim 12, wherein:

the first leg further comprises a first outer surface and a first pair of opposing rails adjacent to and flush with the first outer surface, the first pair of opposing rails being substantially parallel with the first axis;

the second leg further comprises a second outer surface and a second pair of opposing rails adjacent to and flush with the second outer surface, the second pair of opposing rails being substantially parallel to the second axis; and the first pair of opposing rails and the second pair of opposing rails are configured to engage the window frame.

15. The corner drive assembly of claim 12, wherein:

the first interior compartment includes a first pair of opposing channels substantially parallel to the first axis;

the second interior compartment includes a second pair of opposing channels substantially parallel to the second axis; and the first arm is configured to be slidably disposed within the first pair of opposing channels and the second arm is configured to be slidably disposed within the second pair of opposing channels.

16. The corner drive assembly of claim 12, wherein:

the first interior compartment further includes a first pair of opposing grooves substantially parallel to the first axis;

the second interior compartment further includes a second pair of opposing grooves substantially parallel to the second axis; and the first end of the corner transfer spring is slidably disposed in the first pair of opposing grooves and the second end of the corner transfer spring is slidably disposed in the second pair of opposing grooves.

17. The corner drive assembly of claim 12, wherein the corner transfer spring is spaced apart from the surface of the corner portion that defines the third compartment.

18. The corner drive assembly of claim 12, wherein the surface of the corner portion that defines the third compartment is curved.

* * * * *